United States Patent [19]

Dougherty

[11] 4,191,909

[45] Mar. 4, 1980

[54] COLOR CRT WITH SHADOW MASK HAVING PERIPHERALLY GROOVED SKIRT

[75] Inventor: Lawrence W. Dougherty, Sleepy Hollow, Ill.

[73] Assignee: Zenith Radio Corporation, Glenview, Ill.

[21] Appl. No.: 953,400

[22] Filed: Oct. 23, 1978

[51] Int. Cl.[2] ..... H01J 29/07

[52] U.S. Cl. ..... 313/402

[58] Field of Search ..... 313/402, 407, 403, 404, 313/405, 406, 408

[56] References Cited

U.S. PATENT DOCUMENTS

| | | | |
|---|---|---|---|
| 3,345,530 | 10/1967 | Haas | 313/407 |
| 3,809,945 | 5/1974 | Roeder | 313/402 |
| 3,862,448 | 1/1975 | Ishizuka et al. | 313/402 |
| 3,912,963 | 10/1975 | Sedivy | 313/402 |

*Primary Examiner*—Palmer C. Demeo

*Attorney, Agent, or Firm*—Ralph E. Clarke, Jr.

[57] ABSTRACT

This disclosure depicts a CRT (color cathode ray tube) of the shadow mask type, and an improved shadow mask therefor. The CRT has a screen and an electron gun assembly for generating a plurality of electron beams. The improved shadow mask has a dished perforate central portion for selectively transmitting electrons to the screen. The mask has a predetermined surface on a peripheral portion of the mask which is so oriented that when the mask is in place in an operating tube there results an undesirable specular electron reflection of overscanned electrons off the exposed surface and a visible electron flooding of the screen near its perimeter. The shadow mask is characterized by having on the said surface an array of close-spaced grooves oriented to scatter a major fraction of reflected overscanned electrons away from the screen and to thereby markedly suppress the said visible electron flooding of said screen.

4 Claims, 3 Drawing Figures

COLOR CRT WITH SHADOW MASK HAVING PERIPHERALLY GROOVED SKIRT

BACKGROUND OF THE INVENTION

This invention relates in general to an improved shadow-mask-type color CRT (cathode ray tube) characterized by having suppressed electron flooding of the screen by overscanned electrons. It is of course desirable that the picture produced by a television receiver completely fill the visible screen area of the faceplate. To assure this, and thus to prevent any possibility that the ragged edge of the television raster may be seen by the viewer, it is standard practice to "overscan" the viewing area of the screen. That is, the electron beam deflection system is designed and set up such that it makes a picture typically about 7% larger than the visible area of the screen. The outer edge of the picture is wasted, however this is considered to be necessary to assure that the edge of the raster will not be seen.

As a consequence of this deliberate "overscanning" of the visible screen area, at the ends of each excursion of the electron beams, the beams play on exposed areas of the shadow mask. (As is well known, all modern color television tubes utilize a shadow mask to assure that the three electron beams associated with red, green and blue picture information excite only the red-light-emitting, green-light-emitting and blue-light-emitting phosphors, respectively).

However, if provisions are not made, overscanned electrons may reflect off surfaces of the mask (much in the manner in which light reflects off a mirror) and "flood" the screen near its perimeter. Since the scattered electrons lose their color-associated trajectories upon reflection, they impinge upon the screen randomly, producing a visible white light under certain viewing and picture conditions which may degrade the television picture. The reflected electrons also do not represent useful picture brightness intelligence at the point of impingement on the screen. This visible electron flooding of the peripherial area of the screen is, in its visual appearance, not unlike the lights of a city over the horizon.

Conventional shadow mask assemblies include a thin perforate mask member and a heavy rigid frame which is used to give mechanical support to the mask member. In order to prevent overscanned electrons from reflecting off the inside surface of the frame and the rearwardly turned skirt of the mask member, it is conventional to form an inward flange on the back side of the frame which serves as a shield to block passage of overscanned electrons.

It is also known in applications where the shadow mask has no frame, such as disclosed in U.S. Pat. No. 3,912,963, to configure the shadow mask in such a way as to prevent overscanned electrons from being reflected off exposed surfaces onto the visible area of the screen. It is also known from the '963 patent to form ribs in the skirt of a shadow mask assembly for strengthening purposes.

It is also known, for reasons completely unrelated to suppression of visible electron flooding of the screen, to partially pre-etch a pattern of recesses on the outside surface of a shadow mask member in the heel radius region. This is done to minimize stretching and distortion of the shadow mask apertures when the shadow mask member is mechanically formed. See U.S. Pat. No. 3,809,945. Also unrelated—some photographic cameras have baffles to minimize stray ambient light reaching the film plane.

The invention has general applicability to shadow masks of various configurations and types, but perhaps has particular applicability to a CRT having a shadow mask characterized by the lack of a frame and the presence of a rearwardly directed skirt. With such a frameless mask, overscanned electrons are free to reflect off the exposed inner surface of the rearwardly turned skirt and randomly flood the screen through the shadow mask perforations.

OBJECTS OF THE INVENTION

It is an object of this invention to provide a color cathode ray tube of the shadow mask type which has the property that visible electron flooding of the screen when the screen is overscanned is markedly suppressed, without the use of costly and otherwise undesirable separate shields or complex forming of shield members integral with the shadow mask. It is a corollary object to provide an improved shadow mask which makes possible this suppression of electron flooding.

It is another object of this invention to accomplish the aforedescribed suppression of visible electron flooding of the screen without increasing the manufacturing cost of the tube.

DESCRIPTION OF THE PREFERRED EMBODIMENTS

Figure 1:
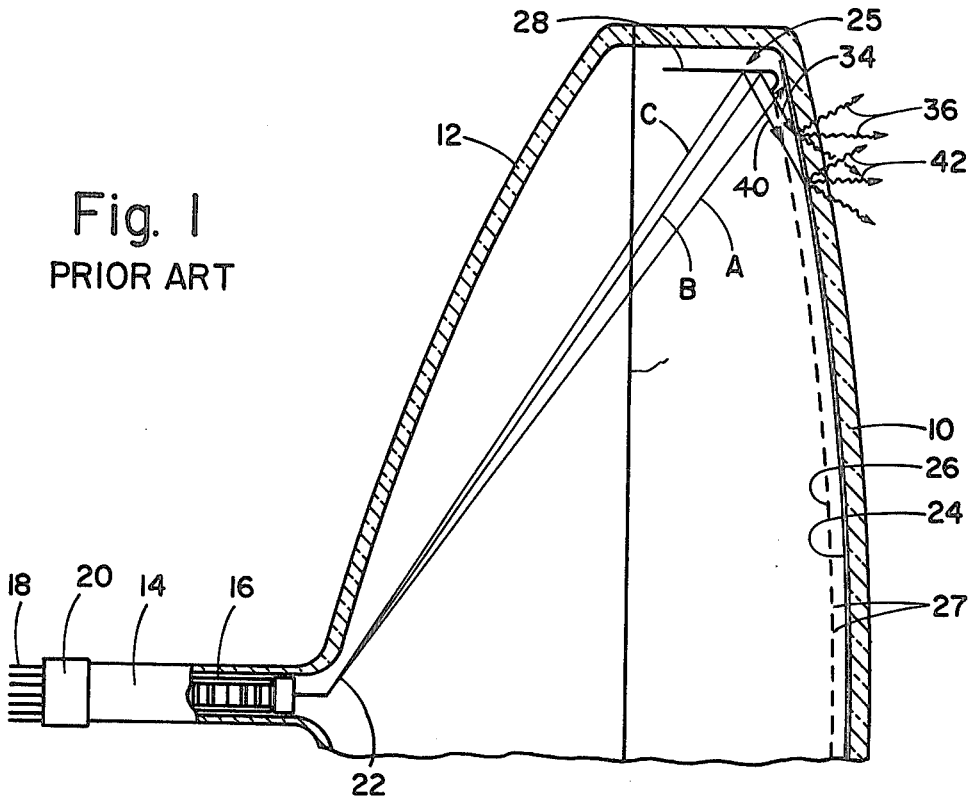
Fig. 1 PRIOR ART
FIG. 1 is a fragmentary, partially sectioned, enlarged schematic side elevational view of a shadow mask type color cathode ray tube illustrating the principle of visible electron flooding of the peripheral area of the screen.

FIG. 1 schematically depicts a color CRT (cathode ray tube) of a type to which this invention may be advantageously applied. The illustrated FIG. 1 CRT includes an envelope having a faceplate 10, a funnel 12 and a neck 14 which together form a hermetic vacuum enclosure.

An electron gun assembly 16 in the neck is supplied with appropriate supply and signal voltages and currents through pins 18 in a base 20. The electron gun assembly produces a fan of three electron beams, shown edge-on at 22. Yoke means for deflecting the electron beams horizontally and vertically across the screen are not shown.

A cathodoluminescent screen 24 is deposited on the inner surface of the viewing area of the faceplate 10.

In order to assure that electron beams associated with the red, green and blue picture information impinge mutually exclusively on red-light-emitting, blue-light-emitting, and green-light-emitting screen elements, a shadow mask 25 is provided. The shadow mask 25 comprises a dished perforate central portion 26 containing apertures 27 for selectively passing electrons to the screen. The mask 25 also comprises a peripheral skirt 28 surrounding the central portion 26.

As used herein, the term "shadow mask" is intended to encompass shadow mask structures of one or more components, including shadow mask assemblies comprising a thin perforate mask member affixed to a rigid frame.

In order that the invention be better understood, a detailed explanation of what is meant by "visible electron flooding" of the screen will now be engaged. In FIG. 1 the fan of electron beams 22 is shown edge-on three different scan positions. Electron beams 22 in position A pass through a peripheral aperture in the mask 25 and impinge upon the cathodoluminescent screen 24. In position B the electron beams 22 are in a moderately overscanned position. Electrons 34 specularly reflected off the skirt 28 pass through mask apertures 27 and randomly impinge upon the screen 24. Rays 36 represent visible light emitted from the screen upon impingement by the reflected electrons 34. As explained above, since the specularly reflected electrons 34 have lost their color-associated orientation upon reflection from the inner surface of the mask skirt 28, their impingement upon the screen is random and the light produced is white. Since the white light emitted has no relationship to the television picture being reproduced, it represents a background illumination which under certain viewing and picture conditions, may degrade the picture quality near the screen periphery.

Beams 22 in position C are in an exaggerated overscanned position. In like manner, specularly reflected electrons 40 impinge upon the screen and produce image-degrading visible white light 42. As mentioned above, since it is universal practice to deliberately overscan the viewed screen area to assure that the edge of the raster is not seen, visible electron flooding of the screen with a shadow mask of the character shown is inevitable.

Figure 2:
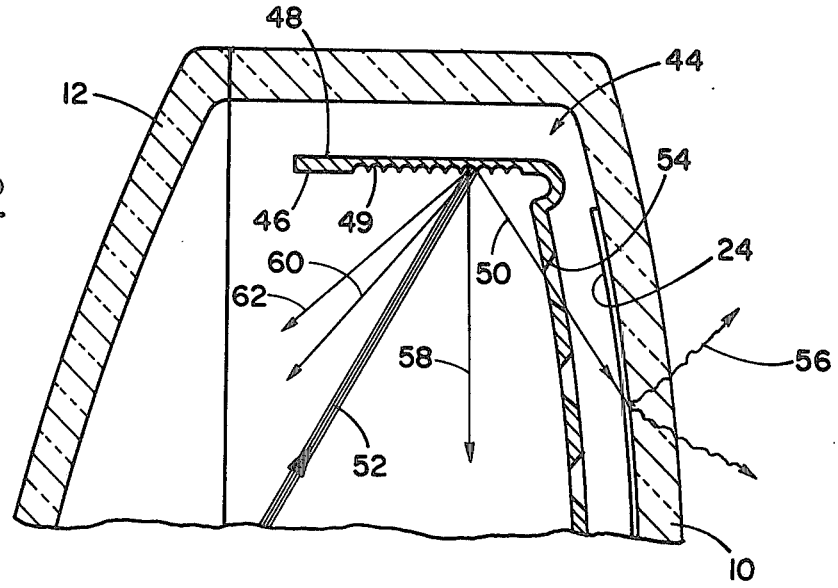
FIG. 2 is an enlarged fragmentary view of an improved tube including a shadow mask according to the present invention.

FIG. 2 depicts a preferred embodiment of the invention. Reference numerals in FIG. 2 which correspond to reference numerals in FIG. 1 denote like structure. It is undesirable that any surface exposed to overscanned electrons be oriented such that when it is impinged upon by overscanned electrons, it specular reflects electrons onto the screen.

FIG. 2 depicts an improved shadow mask 44 according to this invention which suppresses the aforedescribed visible electron flooding of the screen. Specifically, the surfaces exposed to overscanned electrons, here the inside surface 46 of the shadow mask skirt 48, has an array of close-spaced grooves 49 oriented to scatter a major fraction of the reflected overscanned electrons away from the screen so as to suppress the visible electron flooding thereof. In the illustrated perferred embodiment, the grooves 49 are oriented substantially circumferentially. They are thus transverse to the trajectories of the overscanned electrons and act to scatter electrons away from the screen.

FIG. 2 depicts a fan of overscanned electron beams 52 impinging upon inner surface 46 of skirt 48. Specularly reflected electrons 50 from the beams 52 pass through the shadow mask apertures 54 to the screen 24, causing spurious light 56 to be emitted from the screen. However, electrons 58, 60 and 62 are scattered away from the screen 24 by the grooves 49 and do not impinge thereupon.

Experimental tests have shown that provision of circumferential grooves on the inside surface of a skirt of a mask of generally the same character is shown in FIG. 2, reduce the visible electron flooding of the screen by as much as 4:1, that is, to a level 25% of that without grooves 49 (using light output measurements).

Figure 3:
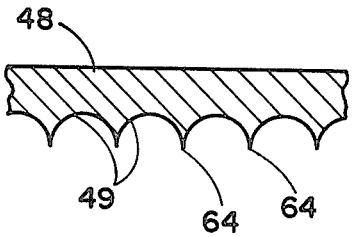
FIG. 3 is an enlarged, fragmentary, sectional view of a portion of the improved shadow mask shown in FIG. 2.

FIG. 3 is an enlarged fragmentary sectional view of the shadow mask skirt 48, showing in more detail the pattern of grooves 49. By way of example, the shadow mask surfaces exposed to overscanned electrons may have grooves spaced on about 4 mil centers. The grooves may be about 2 mils deep. The shadow mask itself is typically about 6–7 mils thick e.g. Ideally, the groove pattern is formed with "no flats", either between the grooves or in the valleys thereof. (Any flats would increase the percentage of electrons reflected towards the screen and would thus decrease the degree of suppression of the electron flooding of the screen). Ideally, the grooves merge to define sharp cusps 64, as shown.

It is an object of the present invention to achieve suppression of visible electron flooding of the screen due to specular electron reflection off exposed shadow mask surfaces at no increase in manufacturing costs. This is accomplished by forming the pattern of grooves 49 in the shadow mask at the same time and by the same process as the apertures 54 are formed in the mask.

As is well known, the apertures in a shadow mask are formed by covering both sides of a shadow mask blank, while flat, with a photoresist and exposing the photoresist to a light pattern which selectively defines those locations where it is desired ultimately to form apertures. After exposure of the photoresist, the coating is developed and etched from both sides to form a pattern of apertures.

An array of grooves 49 according to the present invention can be formed during the aperture-making operation merely by forming an appropriate light pattern on the photoresist-covered surfaces of the mask blank which are to contain a pattern of grooves. As the photoresist is developed and the mask acid-etched, the pattern of grooves is formed. The groove pattern is not exposed on the opposite side and etching therefore results only in the desired grooves on one side and does not produce a thru hole. This is generally referred to as "partial etch." The pattern of grooves 49 is thus made without increasing the cost of manufacture of the mask.

The present invention may perhaps be most advantageously applied to a frameless mask with a rearward skirt of the general character shown in FIGS. 1 and 2. It may also be used, however, on shadow masks and mask assemblies of various configurations having areas exposed to overscanned electrons which might produce visible electron flooding of the screen.

Whereas it is preferred for maximized suppression of electron flooding to have the grooves extend circumferentially and in uninterrupted fashion around the periphery of the shadow mask, in applications where maximum strength of the mask skirt is desired, staggered rows of broken grooves, or other configurations of grooves or recesses may be employed.

While particular embodiments of the invention have been shown and described, it will be obvious to those skilled in the art that changes and modifications may be made without departing from the invention in its broader aspects, and, therefore, the aim in the appended claim is to cover all such changes and modifications as fall within the true spirit and scope of the invention.

I claim:

1. In a color cathode ray tube having a screen, an electron gun assembly for generating a plurality of electron beams, and a shadow mask having a dished perforate central portion for selectively transmitting electrons to the screen and a rearwardly extending skirt surrounding said perforate central area, wherein the improvement comprises said shadow mask having on an inner surface of said skirt an array of substantially circumferentially oriented grooves.

2. In a color cathode ray tube having a screen, an electron gun assembly for generating a plurality of electron beams directed at said screen and a shadow mask having a dished perforate central portion for selectively transmitting electrons to the screen and having a predetermined surface on a peripheral portion of said mask surrounding said central portion, which surface is so oriented that when said electron beams are scanned, there results an undesirable specular electron reflection of overscanned electrons off said exposed surface and a visible electron flooding of the screen near its perimeter, wherein the improvement comprises said shadow mask having on said surface an array of close-spaced grooves oriented to scatter a major fraction of reflected overscanned electrons away from said screen and to thereby markedly suppress said visible electron flooding of said screen.

3. In a color cathode ray tube having a faceplate with an electron-excitable viewing screen, an electron gun assembly for generating a plurality of electron beams directed at said screen, and a shadow mask having a dished perforate central portion for selectively transmitting electrons to said screen and having a predetermined surface on a peripheral portion of said mask surrounding said central portion, which surface is exposed to electron beam bombardment when said beams are overscanned, said surface being so oriented relative to the trajectories of said beams and to said screen that there results an undesirable specular electron reflection off said exposed surface and a visible electron flooding of the screen near its perimeter, wherein the improvement comprises said shadow mask having on said surface an array of grooves oriented transversely to the trajectories of overscanned electrons for scattering a major fraction of said reflected electrons away from said screen to thereby markedly suppress said visible electron flooding of said screen.

4. In a color cathode ray tube having a faceplate with an electron-excitable viewing screen, an electron gun assembly for generating a plurality of electron beams directed at said screen, and a shadow mask having a dished perforate central portion for selectively transmitting electrons to said screen and a rearwardly extending skirt surrounding said perforate central area, the inner surface of said skirt being exposed to electron beam bombardment when said electron beams are overscanned, which combardment results in an undesirable specular electron reflection off said inner surface of said skirt and a visible electron flooding of the screen near its perimeter, wherein the improvement comprises said shadow mask having on said inner surface of said skirt an array of close-spaced, round-bottomed grooves oriented transversely to the trajectories of overscanned electrons for scattering a major fraction of said reflected electrons away from said screen to thereby markedly suppress said visible electron flooding of said screen.

* * * * *